United States Patent [19]

Meyer

[11] Patent Number: 4,688,676

[45] Date of Patent: Aug. 25, 1987

[54] PAD OF TEAR AWAY THERMOPLASTIC CARRYING BAGS

[75] Inventor: Armin Meyer, Cologne, Fed. Rep. of Germany

[73] Assignee: Lemo M. Lehmacher & Sohn GmbH Maschinenfabrik, Niederkassel-Mondorf, Fed. Rep. of Germany

[21] Appl. No.: 939,048

[22] Filed: Dec. 8, 1986

[30] Foreign Application Priority Data

Dec. 11, 1985 [DE] Fed. Rep. of Germany ..... 3543727

[51] Int. Cl.[4] ..... B65D 1/34; B65D 6/04

[52] U.S. Cl. ..... 206/554; 206/806; 206/820

[58] Field of Search ..... 206/554, 806, 820

[56] References Cited

U.S. PATENT DOCUMENTS

| | | | |
|---|---|---|---|
| 1,254,966 | 1/1918 | Bens | 206/554 |
| 3,000,549 | 9/1961 | Stange et al. | 206/554 |
| 3,385,428 | 5/1968 | Kugler | 206/554 |
| 3,646,723 | 3/1972 | Meroney | 206/554 |
| 4,291,807 | 9/1981 | Criordano et al. | 206/806 |
| 4,360,106 | 11/1982 | Irvine et al. | 206/806 |
| 4,500,000 | 2/1985 | Membrino | 206/554 |
| 4,557,384 | 12/1985 | Membrino | 206/554 |

FOREIGN PATENT DOCUMENTS

| | | |
|---|---|---|
| 2228767 | 12/1972 | Fed. Rep. of Germany . |
| 2204638 | 7/1974 | Fed. Rep. of Germany . |
| 2141045 | 7/1974 | Fed. Rep. of Germany . |
| 2526014 | 12/1976 | Fed. Rep. of Germany . |
| 3222376 | 12/1983 | Fed. Rep. of Germany . |
| 3424748 | 1/1986 | Fed. Rep. of Germany . |

*Primary Examiner*—Joseph Man-Fu Moy

*Attorney, Agent, or Firm*—Karl F. Ross; Herbert Dubno

[57] ABSTRACT

The invention is a tear away block of thermoplastic carrying bags in which each of the carrying bags have a front wall, a back wall and two handle grip punch outs in the vicinity of an upper entrance opening. The carrying bags are provided with a sinusoidal shaped entrance opening which bounds a central sine wave region with two handle grip punch outs. A rectangular reinforcing piece of plastic foil is glued on at least one wall of the carrying bags in the vicinity of the handle grip punch outs. The carrying bags are combined in the tear away block with the aid of at least one interlocking heat seal joint in an interlocking section in each of the carrying bags and may be torn away from the tear away block by a row of perforations. The central sine wave region of the rear wall projects with an upper portion above the upper edge of the reinforcing piece, while the corresponding portion of the front wall is removed or folded over so that the upper portion of the rear wall projecting over the upper edge of its reinforcing piece forms the interlocking section. The row of perforations is positioned in the vicinity of and above the upper edge of the reinforcing piece in the upper portion of the rear wall.

4 Claims, 2 Drawing Figures

PAD OF TEAR AWAY THERMOPLASTIC CARRYING BAGS

CROSS REFERENCE TO RELATED APPLICATIONS

This application is related to Ser. No. 749,872, filed June 27, 1985, and to Ser. No. 882,272, filed July 7, 1986.

FIELD OF THE INVENTION

My present invention relates to a block or pad of tear-away carrying bags of a thermoplastic film or foil.

BACKGROUND OF THE INVENTION

A block or pad of thermoplastic carrying bags contains bags of a thermoplastic foil or film each having a front wall, a back wall and two handle grip punch outs in the vicinity of an upper entrance opening.

These carrying bags are each provided with an entrance opening of sinusoidal shaped which bounds a central sine wave region in which the two handle grip punch outs are provided.

A rectangular reinforcing piece of plastic foil can be glued on at least one wall of each of the carrying bags near or over the handle grip punch outs.

The carrying bags are combined in the tear away block with the aid of at least one interlocking heat seal joint or weld in an interlocking section of the bags and the bags may be torn away from the block or removed by tearing along a row of perforations.

For the purposes of my invention the references to the front wall and back wall are interchangeable and will depend upon the use position.

In the tear-away pad described in German Patent Document No. 34 24 748 the reinforcing piece projects with an upper portion beyond the central sine wave region. This projecting upper portion of the reinforcing piece forms the interlocking section at which the bags are connected to form the pad. The row of perforations is found in the reinforcing piece. It runs like a secant under the upper portion of the central sine wave region which lies freely or loosely on the reinforcing piece. Thus the reinforcing piece must be provided with the row of perforations before gluing it on one of the walls.

Tear-away pads are known in which the individual carrying bags are the so-called shirt bags described in German Patent Document No. 22 04 638.

The interlocking heat seal joint runs along an upper edge of the interlocking section from which the shirt bags are torn away. These carrying bags have suitably formed handle punch outs and a tear-away perforation. German Patent Document No. 21 41 045 describes bags where the filling openings are first formed during the tearing away step. The interlocked carrying bags can not be filled in the interlocked state, rather they must be torn off from their tear-away pad.

Carrying bags of thermoplastic foil are known in which the front wall and the back wall have handle-forming punch outs and the upper edges of these walls form the filling opening edge. Further in the vicinity of at least one of these walls at the filling opening edge in the vicinity of its handle forming punch out a reinforcing piece of plastic foil can be glued (German Patent Document No. 25 26 014). These bags cannot be easily interlocked so that the individual carrying bag will be easily manipulable and fillable and only then removable from the pad. A special auxiliary interlocking means (German Patent Document No. 22 28 767), namely a mechanical interlocking device upon which the individual carrying bags are threaded can also be provided. This device is so formed that the front wall of the threaded on carrying bag comes free easily from the device so that the described filling can occur while the back wall of the carrying bag remains held in position.

OBJECTS OF THE INVENTION

It is an object of my invention to provide an improved tear-away pad of thermoplastic carrying bags which will overcome drawbacks of the prior art.

It is also an object of my invention to provide an improved tear-away pad of carrying thermoplastic bags in which the individual carrying bag in the pad state is easily manipulable and also fillable but no additional mechanical devices are necessary to attach the bags to each other.

It is another object of my invention to provide an improved tear-away pad of thermoplastic carrying bags which does not require the use of reinforcing pieces which are provided, before attaching of the bags together, with a row of perforations.

SUMMARY OF THE INVENTION

These objects and others which will become more readily apparent hereinafter are attained in accordance with my invention with a tear-away pad of thermoplastic carrying bags, each of the carrying bags having a front wall, a back or rear wall and two handle grip punch outs in the vicinity of an upper entrance opening, the carrying bags being provided with a sinusoidal shaped entrance opening which bounds a central sine wave region with two handle grip punch outs.

A rectangular reinforcing piece of plastic foil is glued on at least one (and preferably both) of the walls of each of the carrying bags over the handle grip punch outs and the carrying bags are combined in the tear-away pad with the aid of at least one interlocking heat seal joint in an interlocking section and may be torn away at a row of perforations from the tear-away pad.

According to my invention a central sine wave region of the rear wall projects with an upper portion above the upper edge of the reinforcing piece, while the corresponding portion of the front wall is removed or folded over so that the upper portion of the rear wall projecting over the upper edge of the reinforcing piece forms the interlocking section and the row of perforations is provided directly in the upper portion of the rear wall in the vicinity of and above an upper edge of the reinforcing piece.

My invention is based on the fact that a tear-away pad can be easily made from a plurality of carrying bags which have a sine-wave-like entrance opening edge and handle grip punch outs and are provided with reinforcing pieces.

The individual carryable bag of my tear-away pad can be manipulated easily in the padded state and can be filled in that state when an upper portion of the central sine wave region is used as the interlocking section and it is separable by the row of perforations from the associated wall.

It is then no longer necessary to work with reinforcing pieces which have to be previously provided with a row of perforations. Consequently the carrying bags can be made with the sinusoidal filling edge with tested steps (German Patent Document Nos. 25 26 014 and 32

22 376) which allow the required perforations to be formed directly in the sinusoidal wave region of one of the bag walls.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
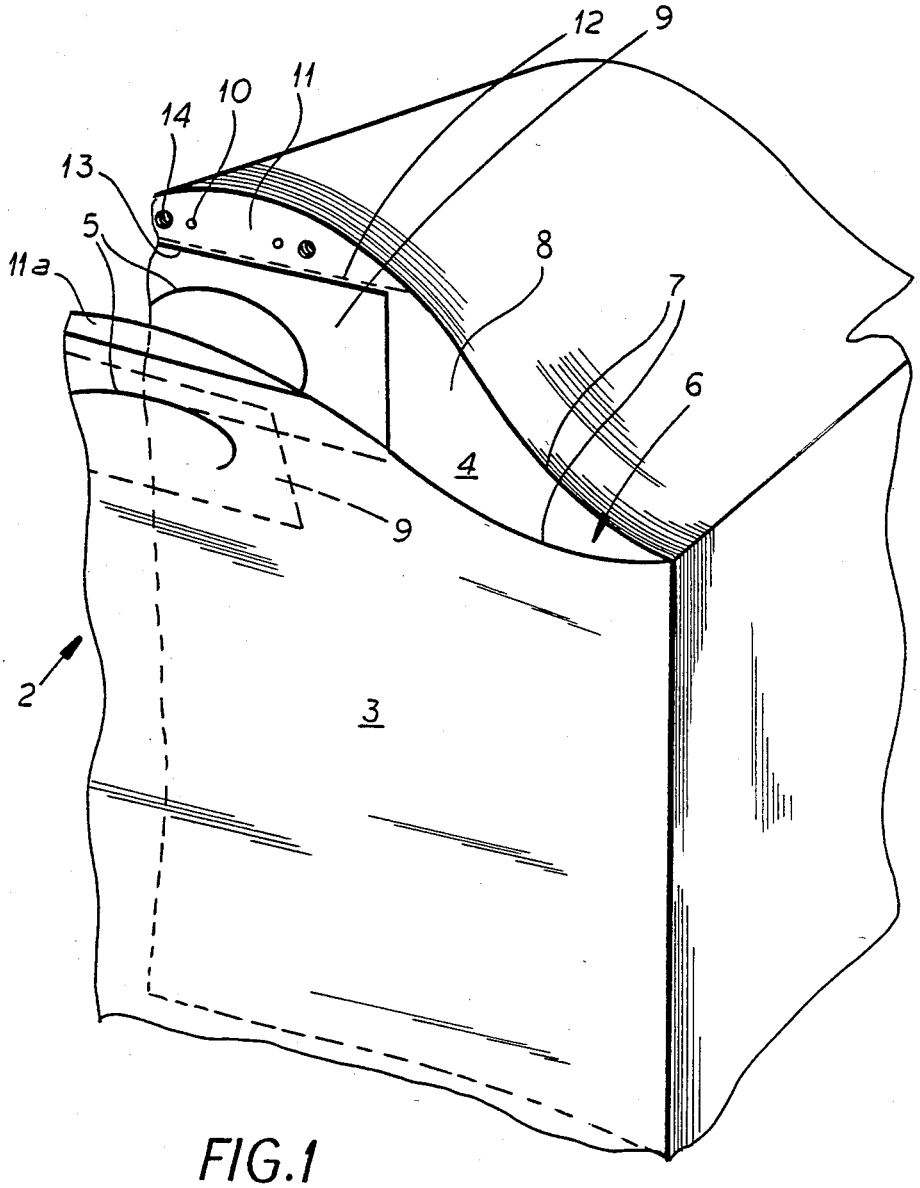
FIG. 1 is a partially cutaway perspective view of a tear-away pad of carrying thermoplastic bags, one bag of which is shown about to be filled.
Figure 2:
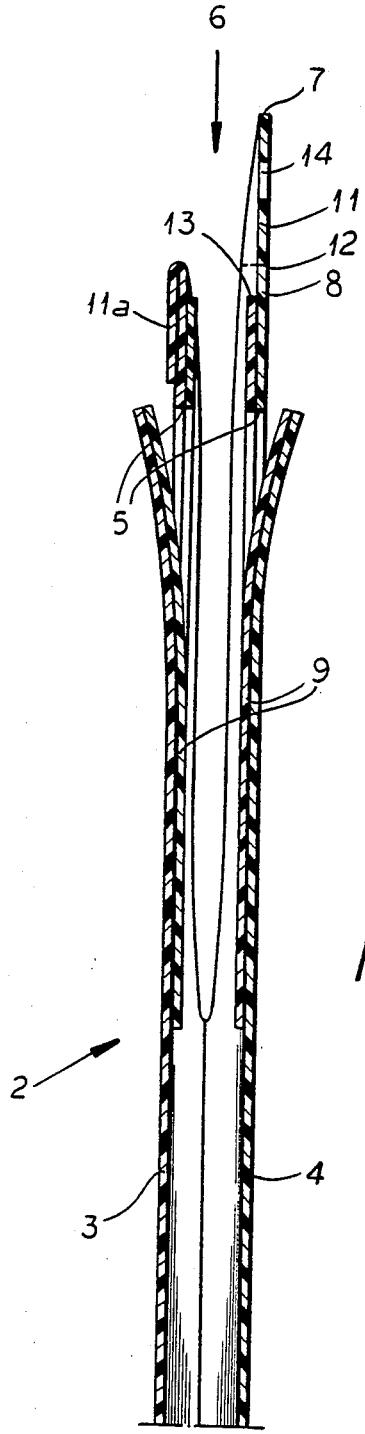
FIG. 2 is a longitudinal cross sectional view through an individual carrying bag from the tear-away pad of FIG. 1 drawn to a larger scale.

The tear-away pad 1 shown partially broken away in FIG. 1 comprises a plurality of carrying thermoplastic bags 2 of which one is shown in FIG. 2 in longitudinal cross section.

Each carrying bag 2 comprises a front wall 3, a back wall 4 and handle grip punch outs 5 near an upper filling opening 6.

The carrying bag 2 has a sinusoidal shaped entrance opening edge 7 which bounds a central sine wave region 8 provided with the handle grip punch outs 5. In this embodiment a rectangular reinforcing piece 9 composed of a plastic foil is glued on each wall 3 and 4 in the vicinity of their handle grip punch outs 5. The individual carrying bags 2 are combined to form the tear-away pad 1 with the aid of an interlocking heat seal joint 10 in an interlocking section 11. They can be torn away individually from the tear-away pad 1 by a row of perforations 12.

From FIGS. 1 and 2 one sees that the central sine wave region 8 of the back wall 4 projects with an upper portion over the upper edge 13 of the reinforcing piece 9, while the corresponding portion 11*a* of the front wall 3 is removed or folded over. The projecting upper portion forms the interlocking section 11. The row of perforations 12 is positioned in this projecting portion of the back wall 4 in the vicinity of and above the upper edge 13 of the reinforcing piece 9. Threading holes 14 are additionally provided, allowing the pad to be mounted on an appropriate fixture, the prongs of which extend through these holes.

I claim:

1. In a tear-away pad of thermoplastic carrying bags, each of said thermoplastic carrying bags having a front wall, a back wall and two handle grip punch outs in the vicinity of an upper entrance opening, said carrying bags being provided with a sinusoidal shaped entrance opening which bounds a central sine wave region which is formed with said two handle grip punch outs, a rectangular reinforcing piece of plastic foil being bonded on at least one of said walls of each carrying bag in the vicinity of said handle grip punch outs, said thermoplastic carrying bags being combined in said tear-away pad by at least one interlocking heat seal joint in an interlocking section so that said thermoplastic carrying bags may be torn away by a row of perforations from said tear-away pad, the improvement wherein:

said central sine wave region of said rear wall projects with an upper portion above an upper edge of said reinforcing piece;

a corresponding portion of said front wall has an upper edge lying below said upper portion so that said upper portion projecting over said upper edge of said reinforcing piece forms said interlocking section; and said row of perforations is formed directly in said upper portion of said rear wall in the vicinity of and above said upper edge of said reinforcing piece.

2. The improvement defined in claim 1 wherein a flap of said front wall is folded over at said upper edge of said front wall.

3. The improvement defined in claim 1 wherein a flap of said front wall is cut away at said upper edge of said front wall.

4. A tear-away pad of thermoplastic carrying bags, each of said thermoplastic carrying bags comprising:

a rear wall with a sinusoidal shaped upper portion having both a reinforcing piece and a handle grip punch out attached thereto in the vicinity of said upper portion, said upper portion projecting over said reinforcing piece to form an interlocking section, said interlocking section having a row of perforations adjacent said reinforcing piece;

a front wall attached with said rear wall to form one of said thermoplastic carrying bags with an upper entrance opening, said front wall being provided with a truncated or folded over sinusoidal shaped upper portion, another of said reinforcing pieces and another of said handle grip punch outs attached thereto in the vicinity of said truncated or folded over sinusoidal shaped upper portion; and at least one interlocking heat seal joint joining said interlocking sections of said rear walls of said thermoplastic carrying bags.

* * * * *